US006851824B2

(12) United States Patent
Hsien

(10) Patent No.: US 6,851,824 B2
(45) Date of Patent: Feb. 8, 2005

(54) DETACHABLE LAMP FOR HAND TOOL

(76) Inventor: Chih-Ching Hsien, 235 Chung - Ho Box 8-24, Taipei (TW)

( * ) Notice: Subject to any disclaimer, the term of this patent is extended or adjusted under 35 U.S.C. 154(b) by 7 days.

(21) Appl. No.: 10/208,903

(22) Filed: Jul. 29, 2002

(65) Prior Publication Data

US 2003/0058637 A1 Mar. 27, 2003

(30) Foreign Application Priority Data

Sep. 26, 2001 (TW) ..... 90216882 U

(51) Int. Cl.[7] ..... B25B 23/18

(52) U.S. Cl. ..... 362/119; 362/191; 362/197; 362/427

(58) Field of Search ..... 362/118, 119, 362/120, 109, 398, 190, 191, 197, 208, 421, 427, 184, 249, 188, 287, 282

(56) References Cited

U.S. PATENT DOCUMENTS 1,875,956 A * 9/1932 Thiel ..... 362/184
2,259,673 A * 10/1941 White ..... 362/197
2,966,580 A * 12/1960 Taylor ..... 362/201
4,302,800 A * 11/1981 Pelletier ..... 362/250
4,423,472 A * 12/1983 Duthu ..... 362/184
4,506,317 A * 3/1985 Duddy ..... 362/396
4,616,297 A * 10/1986 Liu ..... 362/105
4,740,872 A * 4/1988 Chou ..... 362/183
5,010,454 A * 4/1991 Hopper ..... 362/487
5,117,510 A * 6/1992 Broussard et al. ..... 2/209.3
5,195,817 A * 3/1993 Deccio ..... 362/473
5,434,758 A * 7/1995 Zeidler ..... 362/496
5,450,298 A * 9/1995 Fells et al. ..... 362/139
5,951,142 A * 9/1999 Wang et al. ..... 362/109
2002/0105797 A1 * 8/2002 Navid et al. ..... 362/120

* cited by examiner

*Primary Examiner*—Thomas M. Sember
*Assistant Examiner*—Hargobind S. Sawhney

(57) ABSTRACT

A detachable lamp for hand tool is disclosed to include a first lamp unit, a second lamp unit, and a mounting unit connected between the lamp units and adapted to secure the lamp units to the metal body of a hand tool, each lamp unit having a lamp circuit assembly formed of a battery, a conductor, a switch, and a lamp bulb, the mounting unit having a fixed magnetic member adapted to secured the detachable lamp to the metal body of a hand tool by magnetic attraction.

3 Claims, 8 Drawing Sheets

DETACHABLE LAMP FOR HAND TOOL

BACKGROUND OF THE INVENTION

The present invention relates to hand tools and, more specifically, to a detachable lamp for hand tool, which has a mounting unit for fastening to the metal body of any of a variety of hand tools by magnetic attraction.

When using a hand tool in a dark place, the user shall have to hold a hand lamp to provide the necessary illumination. However, it is inconvenient to hold a hand lamp with one hand when using a hand tool with the other hand. There are known hand tools with lamp circuit means. These hand tools are expensive to manufacture. Further, the lamp circuit means tends is constantly kept inside the hand tool, it tends to be damaged or wetted, and the repair and maintenance work of the lamp circuit means is complicated.

SUMMARY OF THE INVENTION

The present invention has been accomplished under the circumstances in view. It is one object of the present invention to provide a detachable lamp, which can easily detachably be installed in any of a variety of hand tools. It is another object of the present invention to provide a detachable lamp, which enables the user to adjust the projecting angle of the lamp bulb. To achieve these and other objects of the present invention, the detachable lamp comprises a, first lamp unit, a second lamp unit, and a mounting unit connected between the lamp units and adapted to secure the lamp units to the metal body of a hand tool. Each lamp unit has a lamp circuit assembly comprised of a battery, a conductor, a switch, and a lamp bulb. The mounting unit has a fixed magnetic member adapted to secure the detachable lamp to the metal body of a hand tool by magnetic attraction.

DETAILED DESCRIPTION OF THE PREFERRED EMBODIMENT

Figure 1C:
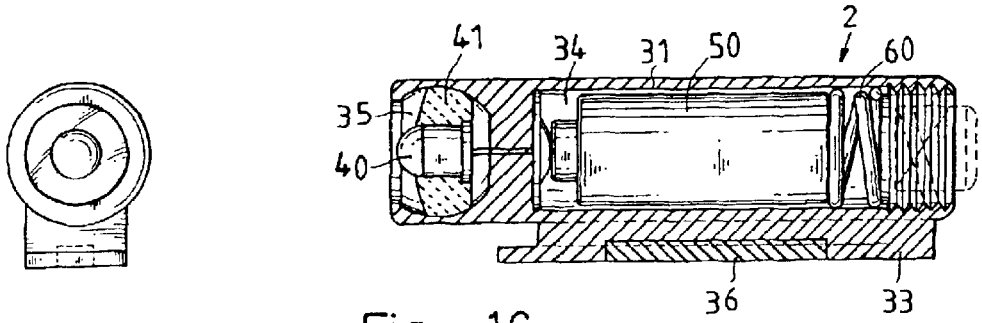
FIG. 1C is a side view in section of the present invention showing an alternate form of the mounting unit.
Figure 1B:
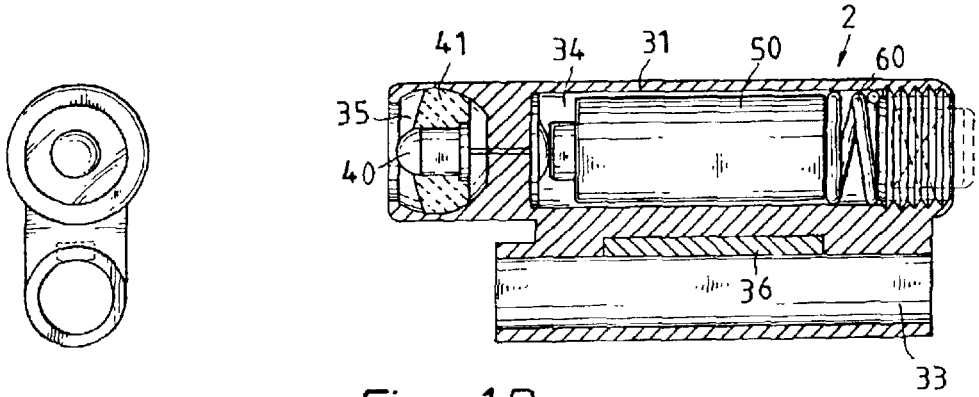
FIG. 1B is a side view in section of the detachable lamp for hand tool according to the present invention.
Figure 1A:
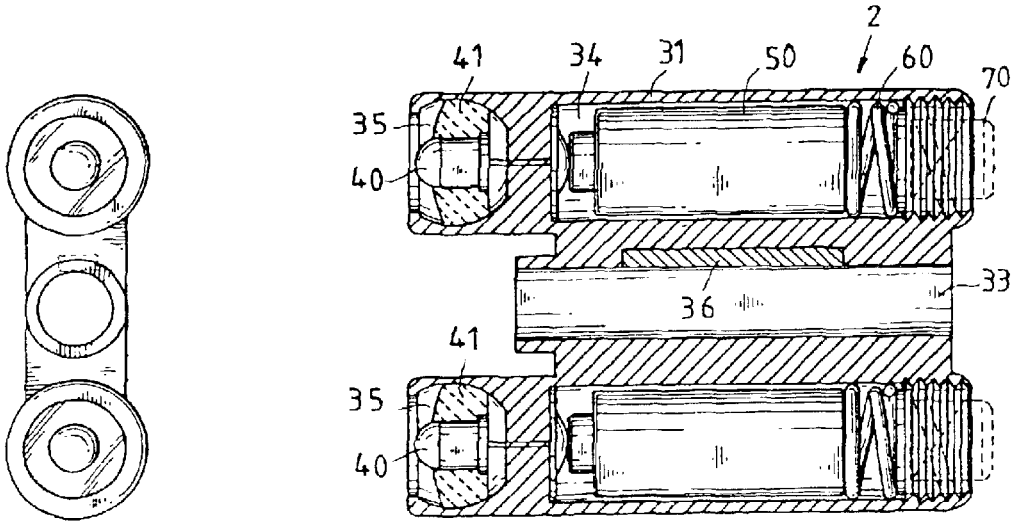
FIG. 1A is a top view in section of the detachable lamp for hand tool according to the present invention.
Figure 1E:
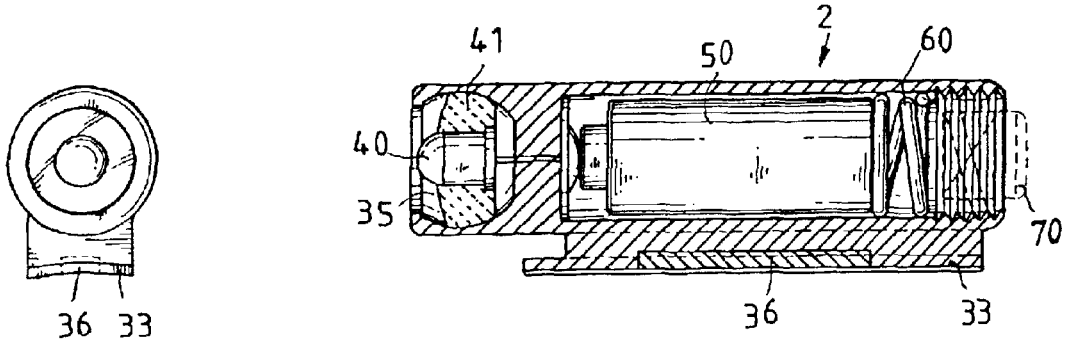
FIG. 1E is a side view in section of the present invention showing still another alternate form of the present invention.
Figure 1D:
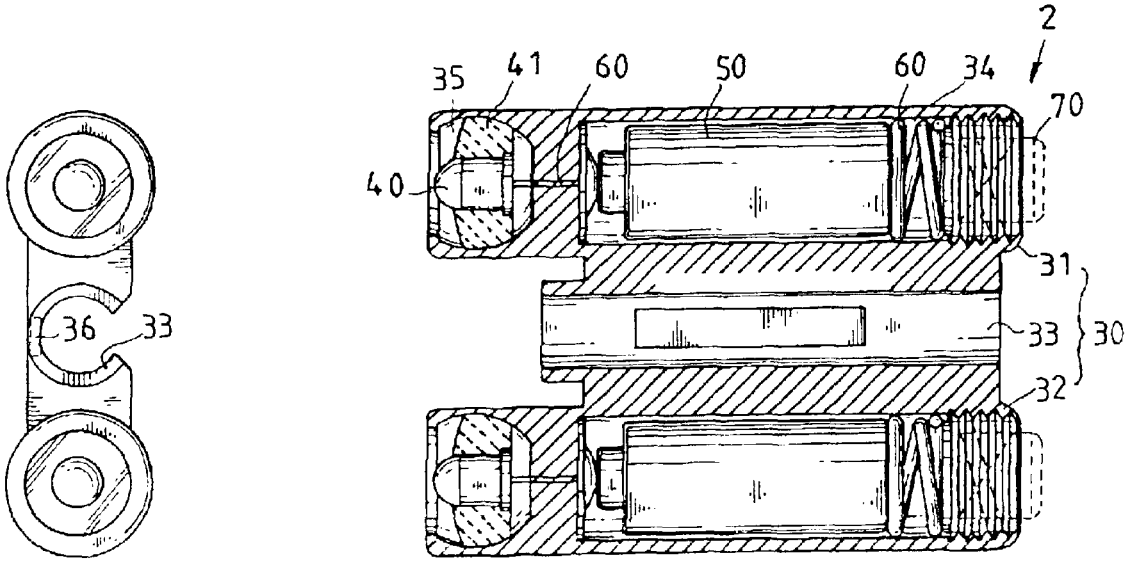
FIG. 1D is a side view in section of the present invention showing another alternate form of the mounting unit.
Figure 2B:
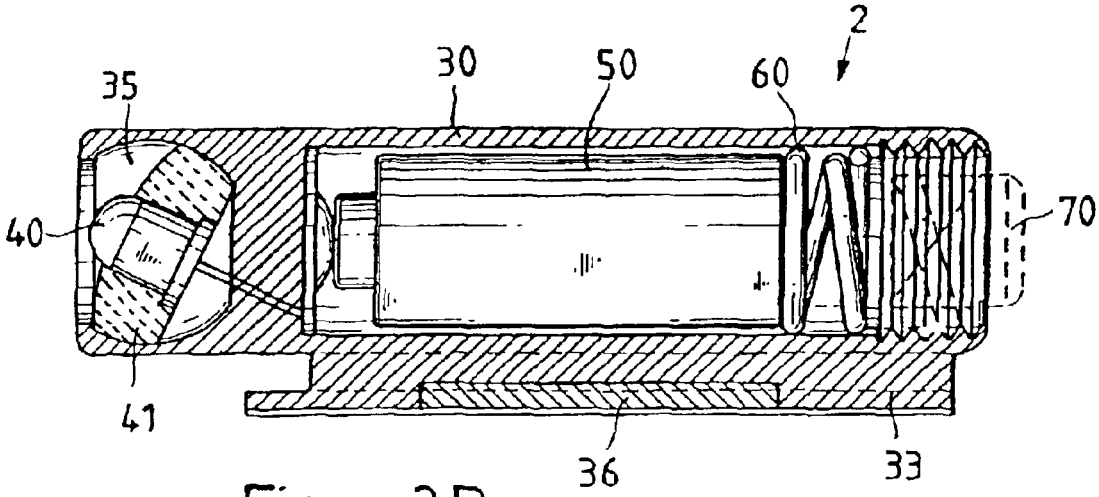
FIG. 2B is similar to FIG. 2A but showing the projecting angle of the lamp bulb adjusted.
Figure 2A:
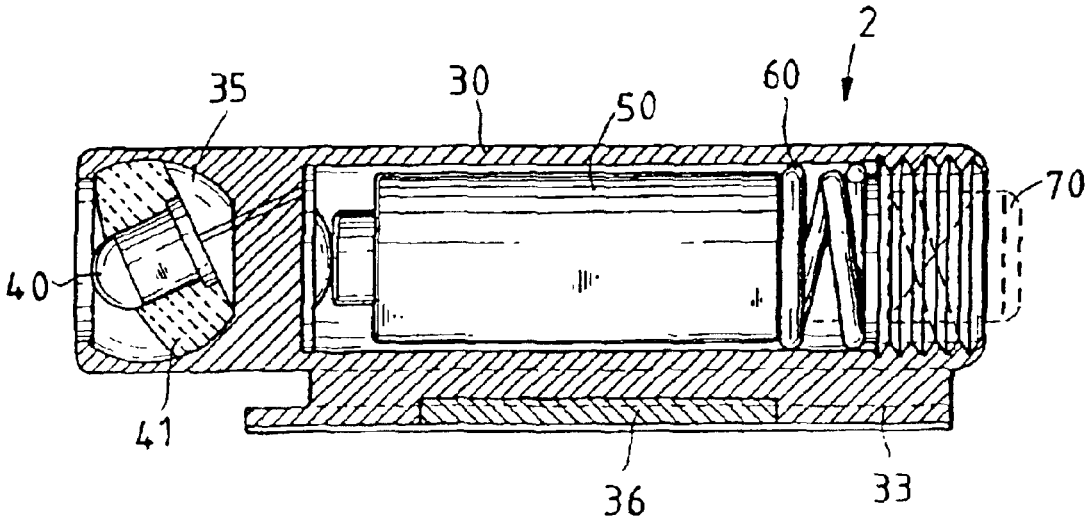
FIG. 2A is a side view in section of the detachable lamp according to the first embodiment of the present invention.
Figure 3A:
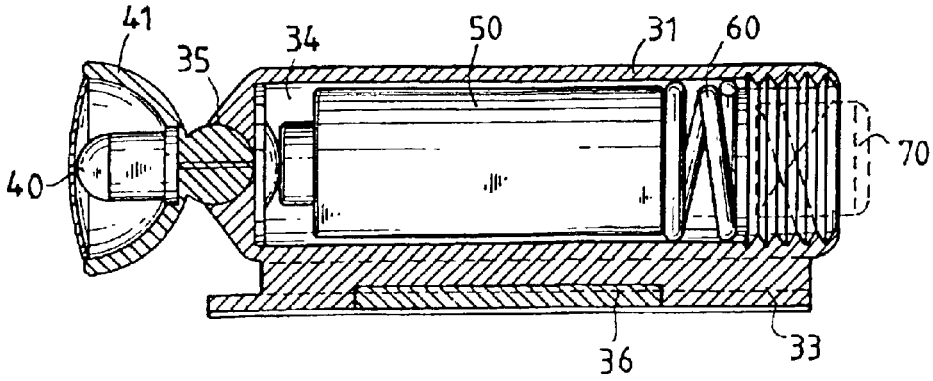
FIG. 3A is a side view in section of the detachable lamp according to the second embodiment of the present invention.
Figure 3B:
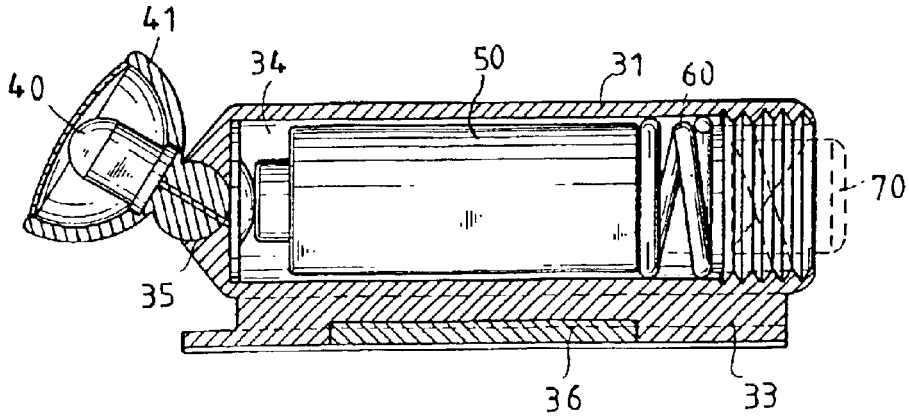
FIG. 3B is similar to FIG. 3A but showing the projecting angle of the lamp bulb adjusted upwards.
Figure 3C:
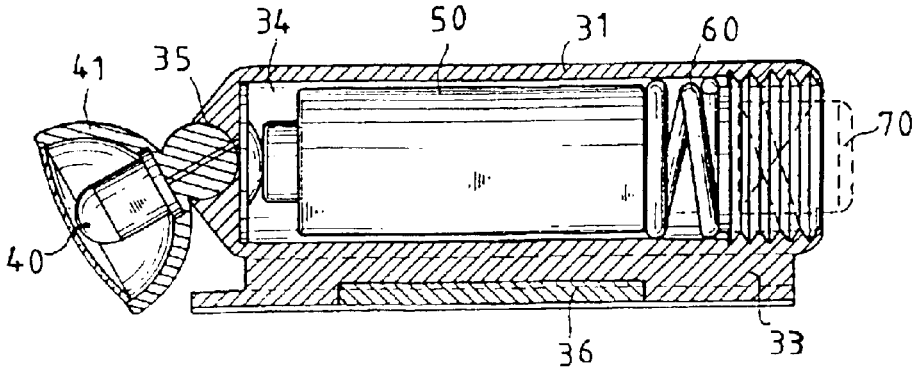
FIG. 3C is similar to FIG. 3A but showing the projecting angle of the lamp bulb adjusted downwards.

Referring to FIGS. from 1 through 4, a detachable lamp 2 is shown comprising a body 30. The body 30 comprises a first lamp unit 31, a second lamp unit 32, and a mounting unit 33 connected between the first lamp unit 31 and the second lamp unit 32. The first lamp unit 31 and the second lamp unit 32 are arranged in parallel, each holding a respective lamp circuit assembly comprised of a lamp bulb 40, a battery 50, a conductor 60, and a switch 70. The lamp unit 31 or 32 has a first chamber 34 holding the battery 50, the conductor 60, and the switch 70 of the respective lamp circuit assembly, and a second chamber 35 holding the lamp bulb 40 of the respective lamp circuit assembly. The mounting unit 33 is a springy plastic member having a magnetic member 36 fixedly secured thereto for fastening to the metal body of a hand tool by magnetic attraction. The mounting unit 33 may be variously shaped. In FIGS. from 1A through 1C, the mounting unit 33 has a tubular shape, and the magnetic member 36 is fixedly fastened to the inside wall of the tubular mounting unit 33. In FIG. 1D, the mounting unit 33 is shaped like a split tube, and the magnetic member 36 is fixedly fastened to the inside wall of the mounting unit 33. In FIG. 1E, the mounting unit 33 is a flat member, and the magnetic member 36 is fastened to the bottom sidewall of the mounting unit 33.

Figure 4A:
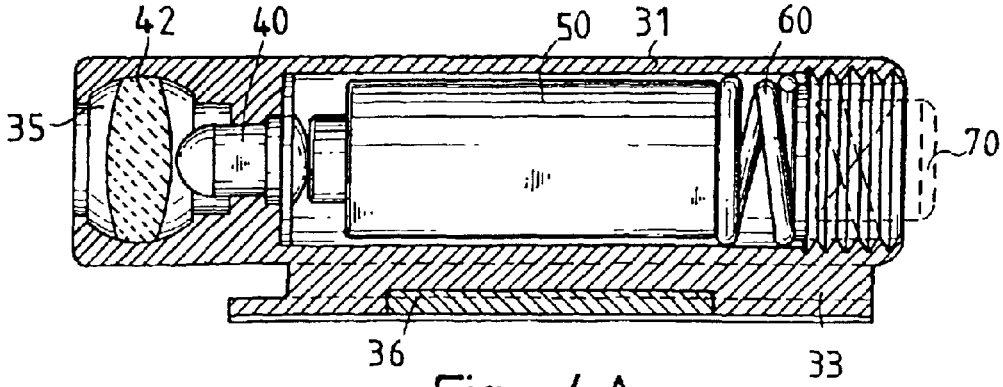
FIG. 4A is a side view in section of the detachable lamp according to the third embodiment of the present invention.
Figure 4B:
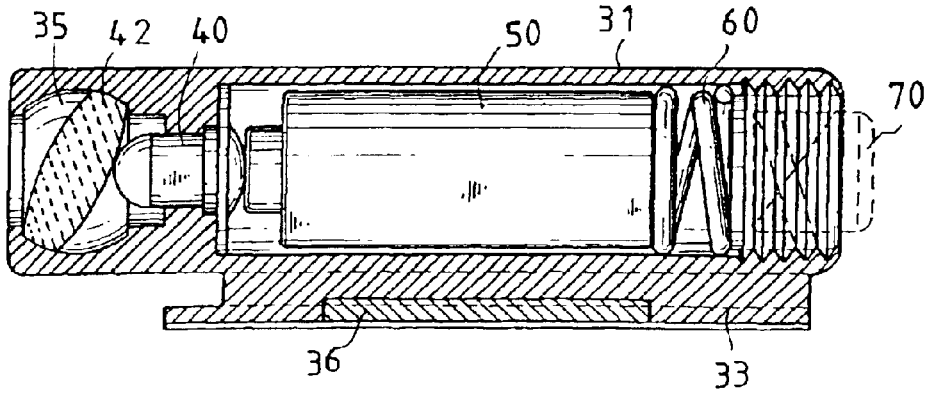
FIG. 4B is similar to FIG. 4A but showing the lens tilted backwards.
Figure 4C:
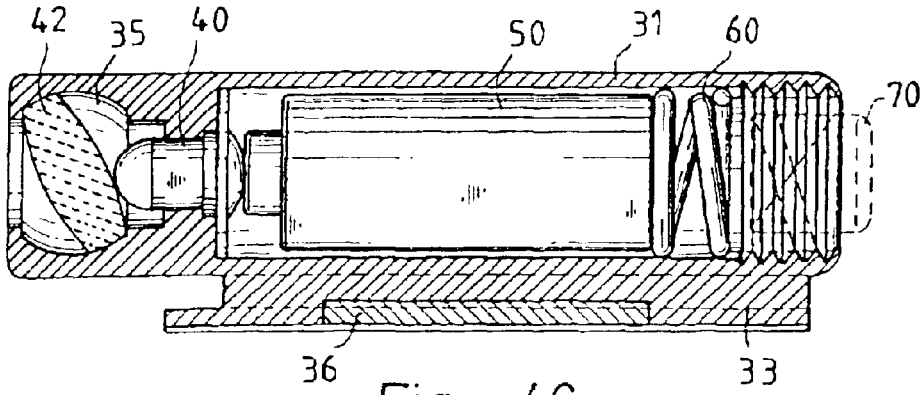
FIG. 4C is similar to FIG. 4A but showing the lens tilted forwards.
Figure 5:
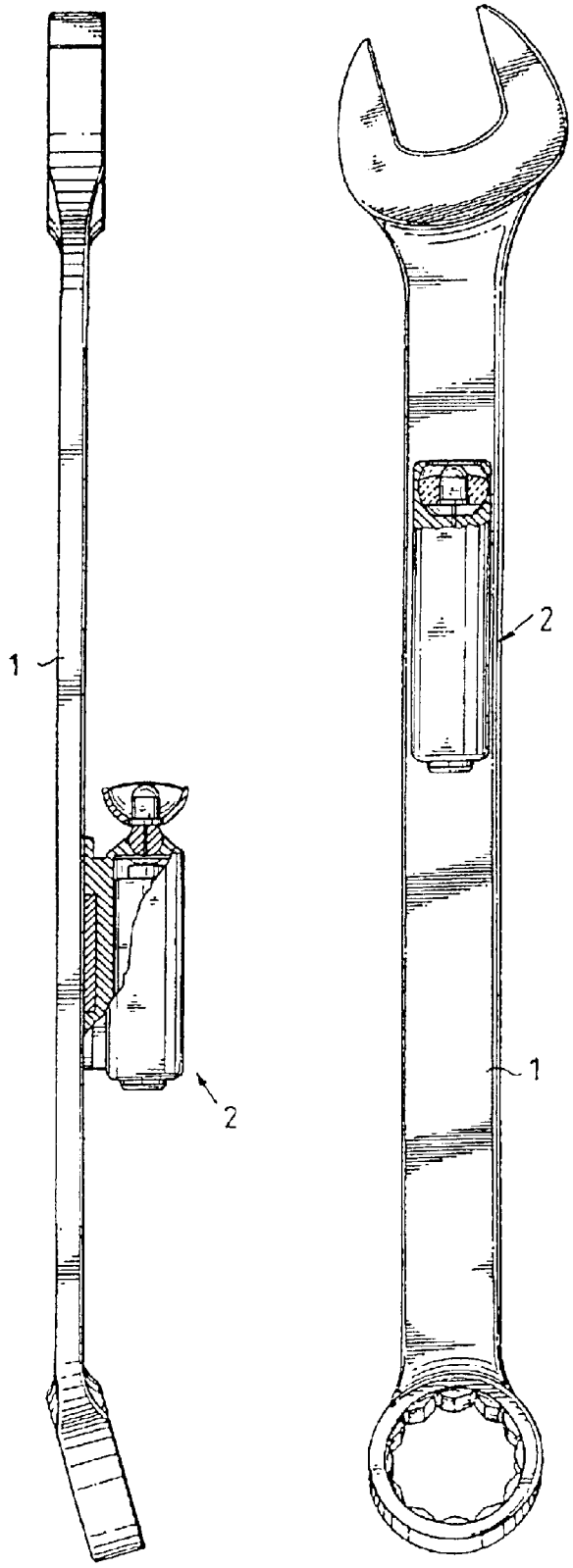
FIG. 5 shows one application example of the present invention.
Figure 6:
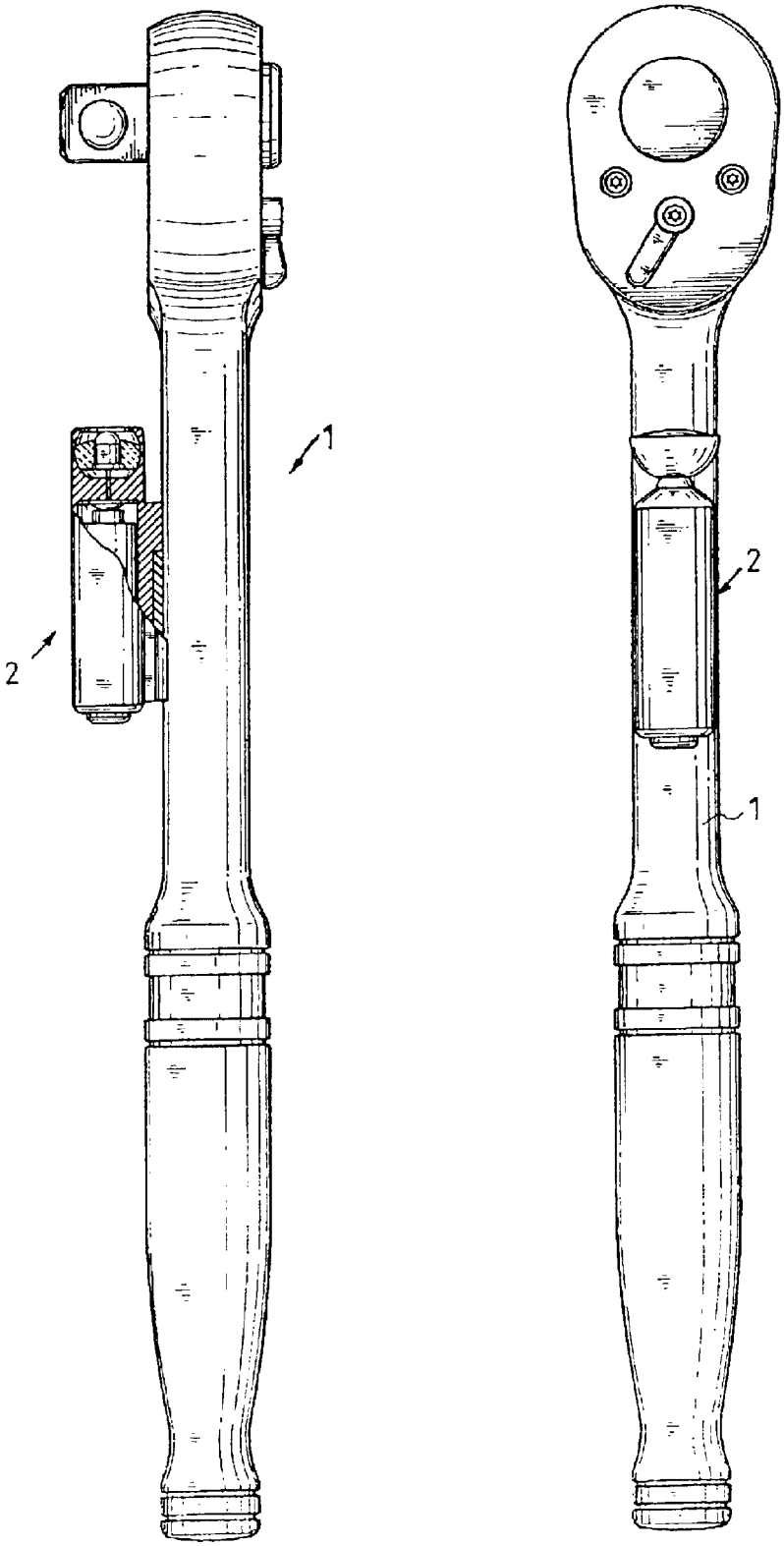
FIG. 6 shows another application example of the present invention.
Figure 7:
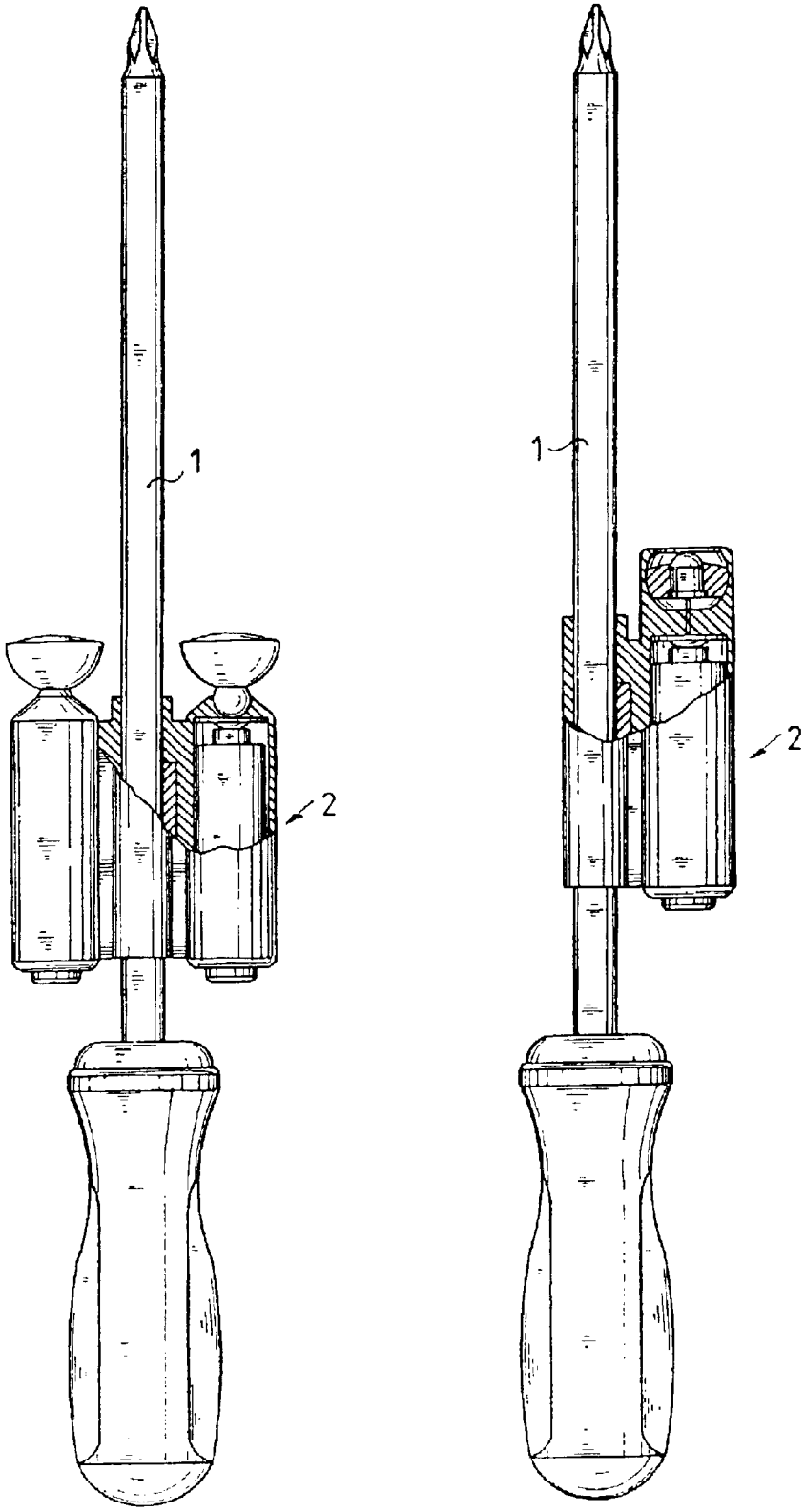
FIG. 7 shows still another application example of the present invention.

In FIGS. 1A~1E, the lamp bulb 40 is fixedly mounted in the second chamber 35 of the lamp unit 31 or 32. In FIGS. 2A~2B and FIGS. 3A~3C, the lamp bulb 40 is mounted in a mount 41 pivoted to the inside of the second chamber 35, so that the user can turn the mount 41 to adjust the projecting angle of the lamp bulb 40. In FIGS. 4A~4C, a lens 42 is pivoted to the inside of the second chamber 35 in front of the lamp bulb 40.

The battery 50, the conductor 60, and the switch 70 are respectively mounted in the first chamber 34 of lamp unit 31 or 32. Because the battery 50, the conductor 60, and the switch 70 are of the known art, no further detailed description is necessary.

Referring to FIGS. from 5 through 7, by means of the mounting unit 33, the detachable lamp 2 can be fastened to the metal body of any of a variety of hand tools 1.

A prototype of detachable lamp for hand tool has been constructed with the features of FIGS. 1~7. The detachable lamp for hand tool functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A detachable lamp for a hand tool comprising a first lamp unit, a second lamp unit, and a mounting unit connected between said first lamp unit and said second lamp unit and adapted to secure said first lamp unit and said second lamp unit to the metal body of a hand tool, said first lamp unit and said second lamp unit each comprising a first chamber, a second chamber, and a lamp circuit assembly, said lamp circuit assembly comprising a battery, a conductor, a switch, and a lamp bulb, said battery, said conductor, and said switch being installed in said first chamber, said lamp bulb being installed in said second chamber, said mounting unit comprising a fixed magnetic member adapted to secure the detachable lamp to the metal body of the hand tool by magnetic attraction;

wherein said lamp circuit assembly further comprises a lens pivoted to the inside of said second chamber in front of said lamp bulb.

2. The detachable lamp for hand tool as claimed in claim 1, wherein said mounting unit is a tubular member of springy plastic material, and said magnetic member is fixedly fastened to an inside wall of said tubular member.

3. The detachable lamp for hand tool as claimed in claim 1, wherein said mounting unit is a split tube of springy plastic material, and said magnetic member is fixedly fastened to an inside wall of said split tube of springy plastic material.

* * * * *